United States Patent [19]

Roccaforte

[11] 4,139,121

[45] Feb. 13, 1979

[54] TAMPER-PROOF DISPENSING CARTON

[75] Inventor: Harry I. Roccaforte, Western Springs, Ill.

[73] Assignee: Champion International Corporation, Stamford, Conn.

[21] Appl. No.: 801,147

[22] Filed: May 27, 1977

[51] Int. Cl.[2] ..... B65D 83/02; B65D 85/20

[52] U.S. Cl. ..... 221/302; 206/45.31; 206/362

[58] Field of Search ..... 206/361, 362, 372, 210, 206/409, 44.12, 491, 494, 45.34, 45.31, 45.12; 221/302, 310, 307, 63, 48

[56] References Cited

U.S. PATENT DOCUMENTS

| | | | |
|---|---|---|---|
| 2,072,695 | 3/1937 | Wellman | 206/491 |
| 2,579,131 | 12/1951 | Tinsley | 206/409 |
| 3,155,273 | 11/1964 | Cote | 206/45.31 |
| 3,239,097 | 3/1966 | Bates et al. | 221/302 |
| 3,301,391 | 1/1967 | Guyer | 206/362 |

*Primary Examiner*—William T. Dixson, Jr.
*Attorney, Agent, or Firm*—Evelyn M. Sommer

[57] ABSTRACT

A tamper-proof dispensing carton particularly suited for packaging of elongated articles is of generally rectangular configuration including a top panel having a central arcuate opening, with a strip extending diametrically across the opening to divide the opening into two segments, and with the strip being releasably connected to the top panel. Secured to the inside surface of the top panel and extending across the arcuate opening is a covering formed by two sections which overlap along a seam disposed immediately below the diametrically extending strip. By this arrangement, the dispensing carton may be displayed on a shelf without requiring an additional outer wrapping, and the consumer may readily obtain access to the contents of the carton by merely removing the diametrically extending strip. The removable strip also functions to make the dispensing carton tamper-proof while on the store shelf.

1 Claim, 3 Drawing Figures

TAMPER-PROOF DISPENSING CARTON

The subject invention relates to a new and improved tamper-proof dispensing carton, and more particularly a dispensing carton that does not require an overwrap layer of transparent film, as is normally found in conventional dispensing cartons.

The use of a split window in a dispensing carton is well-known, and provides an arrangement wherein a carton having an opening, usually in a top panel, includes two pieces of overlapped plastic for closing the opening, yet enabling the consumer to obtain access to articles within the carton by merely extending his or her hand between the split in the overlapped window. However, in order to protect the product while on the store shelf, it is necessary that the entire carton be overwrapped, usually with another sheet of transparent film. The consumer thus is required to remove the outer transparent wrap, and then obtain access to the articles within the carton by passage through the slit in the sheet of transparent film covering the opening in the dispensing carton. At such time, the presence of the split film functions to provide a shield for protection of the remaining articles within the carton. As is readily apparent, the addition of the outer wrap adds to the cost of packaging the articles, and in addition requires an additional manufacturing step, thereby adding to the resulting cost of the product.

Accordingly, it is the object of the subject invention to overcome the shortcomings of prior art dispensing cartons, and more particularly to provide a dispensing carton which is more readily manufactured, includes means for shielding or protecting the product within the carton, provides tamper-proof means for protecting the contents of the carton while on the store shelf, and is less costly than prior art packaging. These and other objects and advantages are realized by the subject dispensing carton which basically comprises a carton having a top panel including an aperture therein of sufficient size to enable the passage therethrough of the articles housed within the dispensing carton. Extending diametrically across the arcuate opening within the top panel is a removable strip, preferably of the same material as the remainder of the dispensing carton, and a sheet of transparent film secured to the under surface of the top panel and covering said arcuate openings. The sheet of transparent film may be perforated along a line which is disposed below and thus hidden by the removable strip, or may be formed by two overlapping sheets of transparent film, with the overlapped seam portion extending immediately below the removable strip. By this arrangement, while on the store shelf, the removable strip covers or "hides" the split between the transparent film covering the aperture in the top panel, thereby inhibiting tampering with the carton or the unauthorized removal of articles from the carton. The ultimate consumer, in order to gain access to the articles within the carton, must first remove the removable strip, and then either perforate the film along the perforation line, or separate the two overlapping sheets of film. It is also noted that, while on the store shelf, if the product has been tampered with, and more particularly if the removable strip has been removed or disturbed, this condition is readily visible to the consumer.

The above objects and advantages, as well as others will become apparent from a reading of the following detailed description taken in conjunction with the drawings in which.

Figure 1:
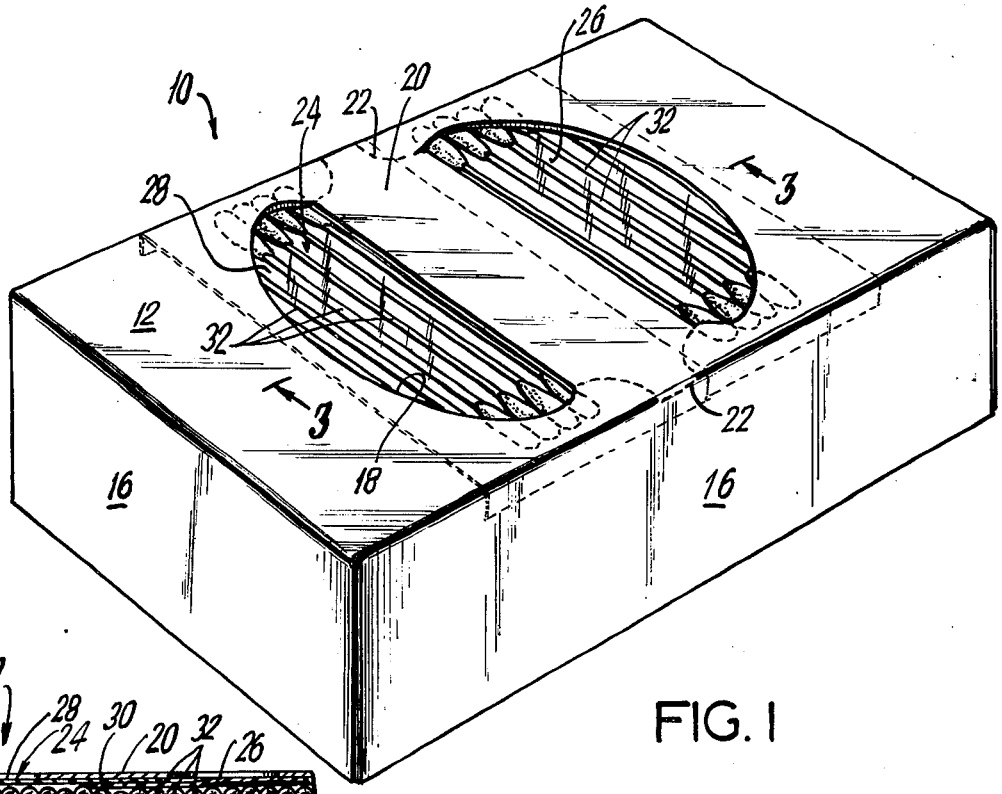
FIG. 1 is a perspective view of the subject dispensing carton in its initial condition, e.g., while on a store shelf.
Figure 3:
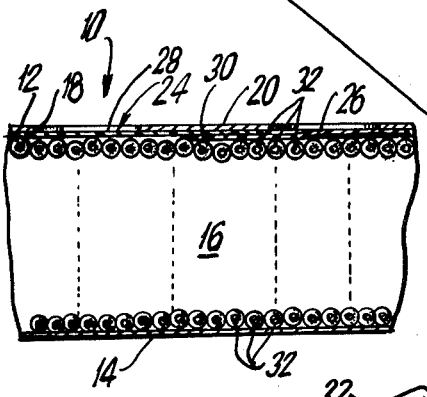
FIG. 3 is a cross-sectional view taken along line 3—3 in FIG. 1.

Referring to FIGS. 1 and 3, the tamper-proof dispensing carton of the subject invention is designated by the numeral 10 and is of generally rectangular plan form. Carton 10 includes a top panel 12, bottom panel 14, and side wall panels 16. The subject tamper-proof dispensing carton is particularly adapted for use in connection with elongated articles such as cotton-tipped swabs designated by the numeral 32. As shown in FIG. 1, the top panel 12 includes an arcuate opening 18 which may be of annular configuration, and which is divided by a diametrically extending strip 20. Strip 20 is preferably formed unitary with the dispensing carton 10, with the dispensing carton preferably being formed of a single blank of cardboard type material. The diametrically extending strip 20 preferably extends across the entire width of the top panel 12, and is releasably connected thereto along perforations 22 at opposite ends of the strip. As more clearly illustrated in FIG. 3, a sheet of plastic film, preferably transparent is secured to the undersurface of the top panel 12 and covers the two segments of the arcuate opening 18. As shown in FIG. 3, the transparent film 24 may comprise two sheets 26 and 28 that are respectively bonded to the undersurface of the top panel 12, and overlap as at 30 along a line or seam extending immediately below the diametrically extending strip 20. By this arrangement, the seam 30 is effectively hidden by the strip 20 when the carton is in its initial condition, as shown in FIG. 1, while on a store shelf. Preferably, the segments of transparent film 26, 28 are not bonded along the seam 30 in order to insure ready access to the articles 32, as mentioned hereinafter.

As long as the diametrically extending strip 20 is connected to the dispensing carton 10, access to the articles 32 is not readily available. Accordingly, while on the store shelf, whether or not the carton 10 has been tampered with is visibly apparent to the consumer.

Figure 2:
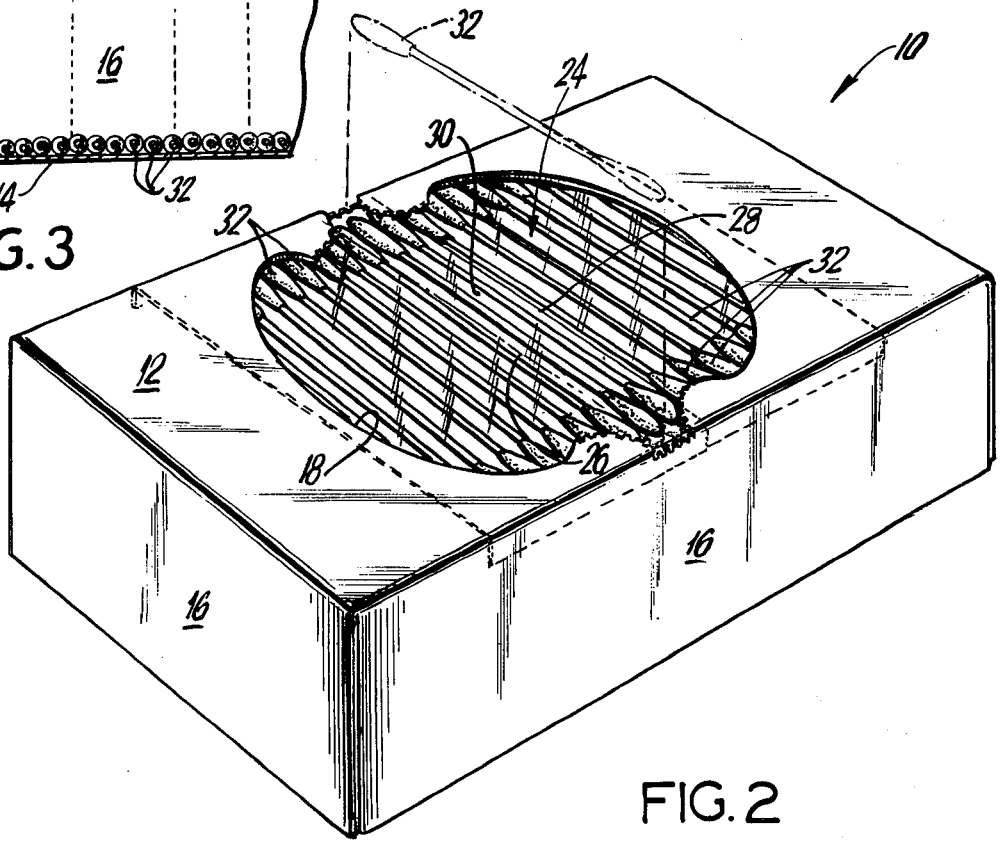
FIG. 2 is a perspective view of the subject dispensing carton following removal of the tamper-proof strip, and illustrating in exploded view the removal of an article from the subject carton.

In use, the consumer merely removes the diametrically extending strip 20 along the perforations 22 thereby leaving the carton as illustrated in FIG. 2. In order to remove an article 32, it is merely necessary for the consumer to reach into the carton and pass the article 32 through the separated transparent film segments 26, 28 at the seam 30. At such time, the presence of the transparent film 24 including the segments 26 and 28 function to protect the articles 32 remaining in the carton for subsequent use.

In an alternate embodiment, the transparent film 24 may be formed of a single sheet which is perforated along a line or seam extending immediately below the diametrically extending strip 20, corresponding to the disposition of the seam 30 in FIG. 3. In the alternate embodiment, it is merely necessary for the consumer to remove the diametrically extending strip 20, and split the transparent film along its perforation to gain access to the articles 32.

The cooperation of the diametrically extending strip 20, and the segments of the transparent film 24 provide an arrangement wherein the initial dispensing carton, as shown in FIG. 1, does not require an overlay or outer wrapping of plastic film to protect the contents of the carton from tampering. The elimination of the plastic overlay wrap thereby provides a less costly and more efficient dispensing carton, yet provides the desirable characteristic of being tamper-proof.

While there has been shown and described specific embodiments of the present invention, it will be understood that the invention should not be limited exactly thereto, since various modifications or alterations may be made without departing from the spirit and scope of the invention as defined by the following claims.

What is claimed is:

1. A substantially rectangular tamper-proof carton for containing and dispensing elongated articles, said articles being disposed perpendicular to the lengthwise dimension of the carton, said carton comprising top, bottom, and sidewall panel members, said top panel including a first semi-elliptical opening having a length less than that of said elongated articles, the lengthwise dimension of said first semi-elliptical opening being disposed perpendicular to the length of the carton; said top panel further including a second semi-elliptical opening having a length less than that of said elongated articles, the lengthwise dimension of said second semi-elliptical opening being disposed perpendicular to the length of the carton; a substantially rectangular strip member disposed between said first and second openings, and having its lengthwise dimension perpendicular to the length of the carton, the central portion of said strip member having a length greater than that of said elongated articles; and a sheet of transparent film secured to the inner surface of said top panel, said film being formed of two overlapping segments, each film segment covering one of said semi-elliptical openings, said film segments overlapping along a seam disposed immediately below said strip member.

* * * * *